US005626493A

United States Patent [19]

Post et al.

[11] Patent Number: 5,626,493

[45] Date of Patent: May 6, 1997

[54] THROUGH-WALL ELECTRICAL CONNECTOR

[75] Inventors: Lothar A. Post, Offenbach; Harald Schmitt, Alsbach-Hähnlein, both of Germany

[73] Assignee: The Whitaker Corporation, Wilmington, Del.

[21] Appl. No.: 551,619

[22] Filed: Nov. 1, 1995

[30] Foreign Application Priority Data

Nov. 15, 1994 [GB] United Kingdom ..... 9423021

[51] Int. Cl.[6] ..... H01R 13/73

[52] U.S. Cl. ..... 439/555; 439/317; 439/686

[58] Field of Search ..... 439/555, 557, 439/546, 547, 549, 562, 686, 695, 701, 681, 317

[56] References Cited

U.S. PATENT DOCUMENTS 3,008,116 11/1961 Blanchenot ..... 439/317

4,820,204 4/1989 Batty ..... 439/681

*Primary Examiner*—Gary F. Paumen

*Assistant Examiner*—T. C. Patel

*Attorney, Agent, or Firm*—Driscoll A. Nina

[57] ABSTRACT

An electrical connector housing fixable within an opening of a wall comprising an inner housing and an outer housing, the inner housing having a terminal receiving passageway therein, characterized in that in response to relative movement between the housings resilient members which have passed through the opening are expanded outward preventing the housing from backing out of the wall, thereby providing a through-wall housing that is easily inserted and affixed to a wall from one side thereof.

15 Claims, 4 Drawing Sheets

THROUGH-WALL ELECTRICAL CONNECTOR

BACKGROUND OF THE INVENTION

1. Field of the Invention

This invention relates to electrical connectors and in particular those electrical connectors that are mounted in a wall in order to form an electrical interconnection therethrough.

2. Description of the Prior Art

In industry there is a need for forming electrical connections across partitions or walls. One example of this is door-to-body electrical connections that must occur in an automobile. Another example would be in the electronics area where it is necessary to form and interconnection across the panels of an outer housing surrounding electronic equipment. There have been numerous connectors designed for this application.

One reoccurring problem though is that it is often necessary for the mating connector halves to be interconnected while having access to only one side of the wall or panel. This requires a first connector half to be inserted into an opening in the wall or panel and then retained there, which must occur with access to only one side of the panel. While it is simple enough to prevent the connector half from being overinserted by simple incorporating a shoulder upon the connector half, the difficulty is in assuring the that connector half does not push back out of the opening as that whatever features are on the opposite side of the opening must have passed therethrough, making it difficult to establish an interference to prevent the undesired back-out. In addition, the retention must be sufficiently robust, that when the mating connector half is inserted from the other side of the wall, the connector half mounted in the wall may not be permitted to back-out.

SUMMARY OF THE INVENTION

It is an object of this invention to provide an electrical connector half that is mountable in an opening of a panel or wall from one side thereof and is positively retained.

It is another object of this invention that the electrical connector should be economical, easy to manufacture, and easy to use.

It is yet another object to provide an electrical connector that may be adapted for a sealed interconnection.

These and other objects are accomplished by providing an electrical connector for mounting in an opening through a wall, where the connector comprises an inner housing having at least one terminal receiving passageway therein and an outer housing mounted thereupon, the electrical connector including a back-up shoulder extending outward beyond the opening to interfere with the wall, characterized in that the electrical connector includes at least one resiliently expansive retention member having a first position where the retention member passes through the opening without interference with the wall and a second position achieved by relative movement between the inner and outer housings, overlapping the wall to retain the electrical connector therewith.

DETAILED DESCRIPTION OF THE PREFERRED EMBODIMENT

Figure 1:
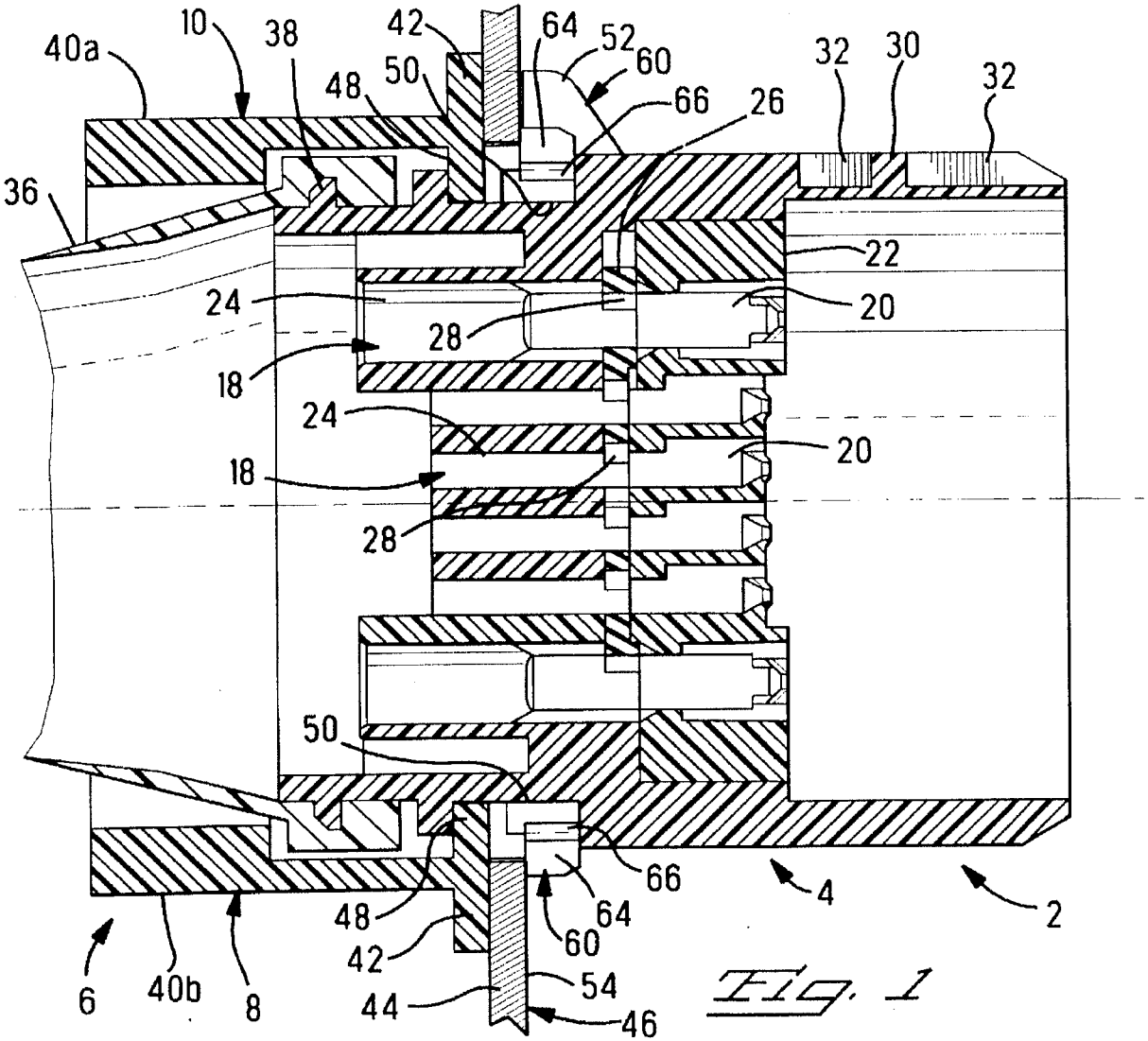
FIG. 1 is a sectional side view of an electrical connector according to the present invention.
Figure 3:
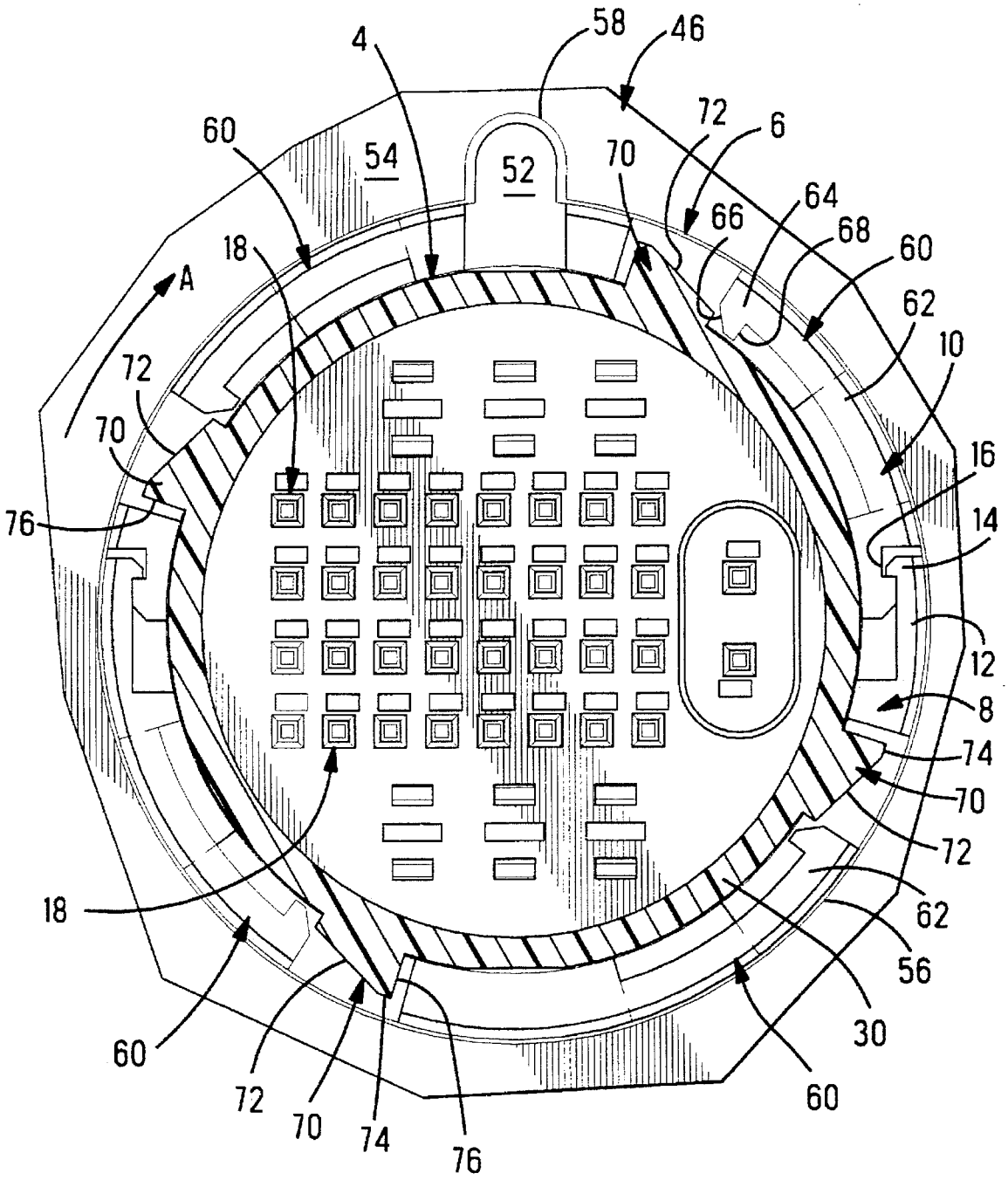
FIG. 3 is front sectional view of the electrical connector of FIG. 1 inserted into the opening of FIG. 2 and showing the connector in an unlatched position.
Figure 4:
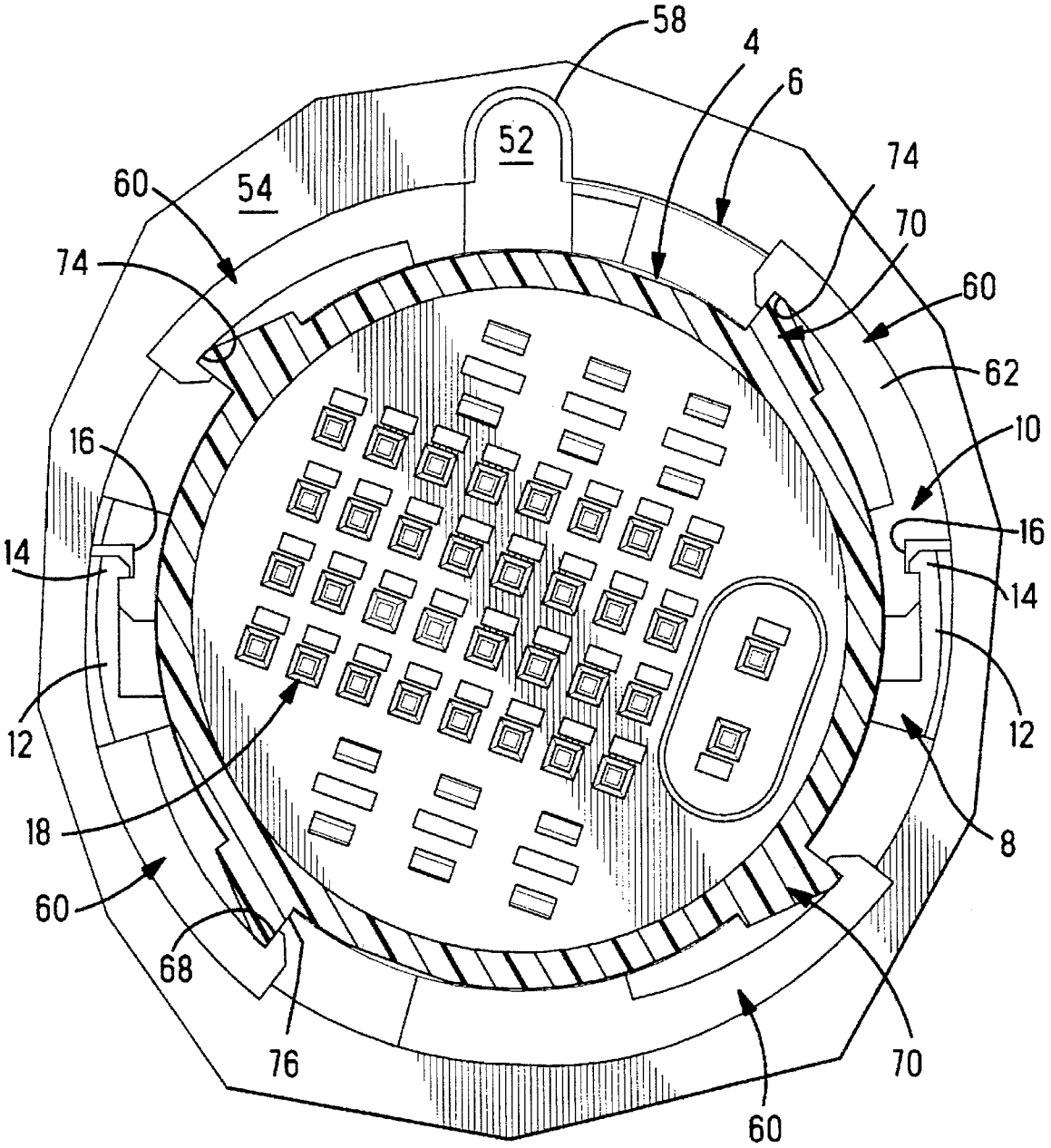
FIG. 4 shows the electrical connector of FIG. 3 in the latched position.

With reference first to FIG. 1, an electrical connector according to the present invention is shown generally at 2. The electrical connector 2 includes an inner housing 4 and an outer housing 6. The outer housing comprises a lower portion 8 and an upper portion 10 which are C-shaped members interconnected at their free legs, thereby being captivatively mounted to the inner connector housing 4. As shown in FIGS. 3 and 4, the free ends of the lower portion 8 include resilient locking arms 12 having a retention lug 14 thereupon that are seated within seats 16 at the free ends of the upper portion 10. When the portions 8,10 are brought together the free ends snap together.

Figure 5:
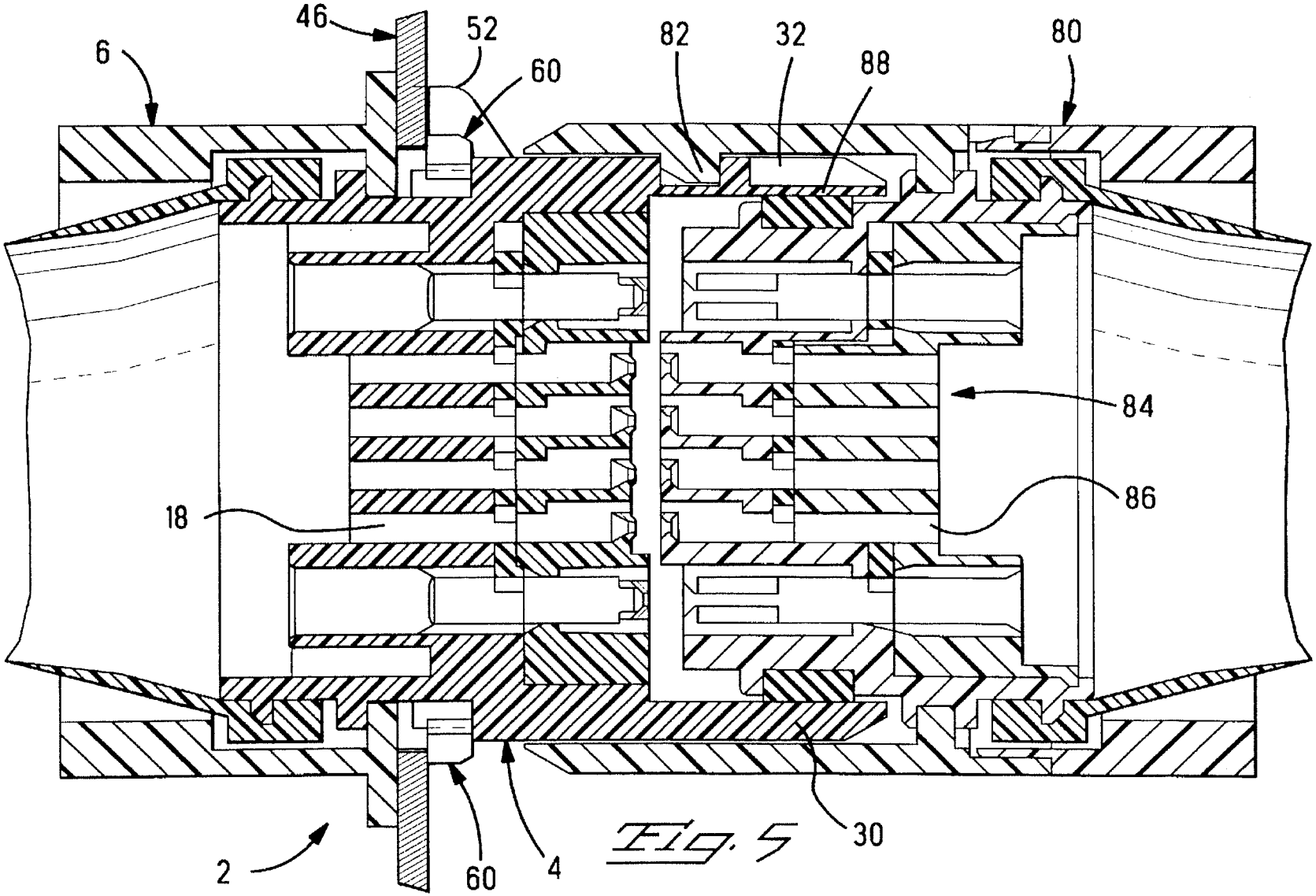
FIG. 5 is a side sectional view of the electrical connector of FIG. 1 showing a mating connector housing attached thereto.

The inner housing 4 is a terminal block having at least one terminal receiving cavity 18 extending therethrough. The cavities 18 include a forward portion 20 at least partially formed within a plate 22 that is fit to the inner housing 4. A rearward portion 24 is aligned with the forward portion 20 and extends rearward through the inner housing 4. Captivated between the plate 22 and the inner housing is a secondary locking member 26 having a tab 28 that extends into the terminal receiving cavity 18 to prevent a contact (not shown) from backing out therefrom over time. Extending in the forward direction is a shroud 30 that includes locking tracks 32 for retaining a mating connector 80 (FIG. 5). Extending from the rearward side of the inner housing 4 is a flexible boot 36 for sealing about a cable (not shown) carrying the contact to be held within the terminal receiving cavities 18 of the housing 2. The boot 36 is retained upon a barb 38.

The upper and lower portions 10,8 that make up the outer housing 6 include a rearward shroud portion 40*a* and 40*b* respectively that extends outward over the rearward side of the inner housing 4 and the boot 36. Forward thereof is a back-up shoulder 42 that abuts the rearward side 44 of a wall 46 to prevent the connector housing 2 from passing through the wall 46. Extending inward from the back-up shoulders 42 are retention shoulders 48 which are captivated within an annular groove 50 of the inner housing 4, enabling at least some relative movement therebetween. Extending forwardly from the shoulder 42 of the upper portion 10 is a key 52 which advantageously prevents relative movement between the wall 46 and the outer housing 6, as described below.

Figure 2:
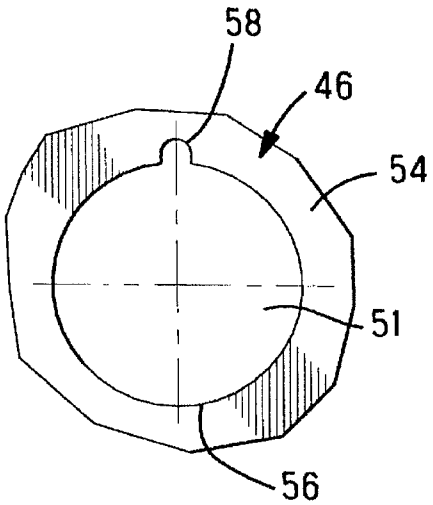
FIG. 2 is a front view of an opening in a wall for receiving the electrical connector of FIG. 1.

With reference now to FIG. 2, an opening 51 extends through wall 46. Wall 46 has a rearward side 44 (FIG. 1) and a forward side 54. The opening 51 has a perimeter edge 56 which advantageously includes a notch 58 for receipt of the key 52, thereby preventing movement of the outer housing 6 and the wall 46.

With reference now to FIG. 3, the electrical connector 2 is received within the opening 51 such that the key 52 is disposed within the notch 58. Each of the upper and lower portions 10,8 which make up the outer housing 6 include two resiliently expandable retention members 60 on the forward end thereof. Each of these retention members 60 includes a cantilevered arm portion 62 with a locking head 64 at the extreme end thereof. The locking head 64 includes a camming ramp surface 66 and a retention surface 68. When the connector 2 is inserted through the wall 46, these resilient members 60 are in their first position which enables them to be inserted through the opening 51 at least slightly beyond the forward side 54 of the wall 46.

Disposed upon the inner housing 4 are four biasing tabs 70, one each corresponding to the resilient members 60. The biasing tabs 70 include a ramp surface 72 for cooperating with the camming surface 66 of the head 64 of the retention members 60 for displacing the retention member outward. Continuous with the ramp surface 72 is a peak surface 74 spaced sufficiently outward radially so that the retention members 60 are displaced beyond the edge 56 of the opening 51 in the wall 46 when the arm 62 is resting thereupon, as best seen in FIG. 4. A latching shoulder 76 is also included that abutting engages the shoulder 68 of the head 64 to prevent disengagement therebetween.

In order to achieve the locked or retained position shown in FIG. 4, the inner housing 4 is moved relative the outer housing 6 in the direction of Arrow A. The relative movement results in the camming surfaces 66 to ride over the ramp surface 72 which outwardly displaces the resilient arms 60. As the resilient arms 60 are on the forward side 54 of the wall 46, the wall 46 is being captivated between the arms 60 and the shoulder 42.

As best seen in FIG. 4, the electrical connector 2 is shown in its latched position fixed within wall 46. In this position, the biasing members 70 have displaced the retention members 60 outward beyond the edge 56 of the opening 51 and the retention members 60 are resting on the biasing members 70, thereby preventing the connector housing 2 from being withdrawn from the wall 46 with the retention members 60 are seated upon the peak surfaced 74 of the biasing members 70, the shoulders 68 and 76 are in retaining abutment, thereby preventing further rotation of the inner housing 4 in the direction of Arrow A may be prevented by incorporating stops within the groove 50 of the inner housing 4.

With reference now to FIG. 5, the electrical connector 2 of the present invention is coupled with a mating connector 80 by way of a locking lug 82 received within the retention slots 32 of the shroud 30. The mating 80 includes a terminal block portion 84 having terminal receiving cavities 86 that correspond to the terminal receiving cavities 18 of the connector 2. A seal 88 is incorporated upon the terminal block portion 84 for forming a sealed fit with the interior of the shroud 30 when the connector halves are mated. The mating may be accomplished without concern of disengaging the connector 2 from the wall 46 as the retention members 60 have been resiliently expanded to oppose any forces resulting from the mating by way of interference with the wall 46.

As used herein, terms such as "forward" and "rearward" relate to the direction of insertion of the housing into the wall and "upper" and "lower" relate to the view of the figures. These are meant for convenience only and are not meant to be limiting. In addition, other shapes may be used with more or less contact receiving passageways may easily be incorporated. Furthermore, while rotational relative is shown other movement may be useful.

We claim:

1. An electrical connector fixable within an opening through a wall comprising an inner housing having at least one terminal receiving passage therein and an outer housing mounted thereupon, the electrical connector having a back-up shoulder extending outward beyond the opening to interfere with the wall to prevent overinsertion characterized in that the electrical connector includes at least one resiliently expansive retention member having a first position where the retention member passes through the wall and a second position, achieved by relative movement between the inner and outer housings, wherein the retention member overlaps the wall to retain the connector therewith.

2. The electrical connector of claim 1, further characterized in that the back-up shoulder and the resilient member are on the outer housing.

3. The electrical connector of claim 1, further characterized in that the inner housing is rotationally displaceable relative the outer housing.

4. The electrical connector of claim 1, further characterized in that one of the housings includes a key receivable in a notch of the wall to orient the connector and maintain the housing rotationally stationary relative the wall.

5. The electrical connector of claim 1, further characterized in that the resiliently expansive retention member is formed as an arm fixed at one end to one of the housings and includes a free end opposite therefrom having a locking head including a camming ramp surface that cooperates with a ramp surface of a biasing tab upon relative displacement of the housings to expand the resiliently expansive retention member.

6. The electrical connector of claim 5, further characterized in that the locking head further includes a retention surface and the biasing tab including a shoulder that cooperates with the retention surface to maintain the second position.

7. The electrical connector of claim 5 or 6, further characterized in that the resiliently expansive member is supported by a peak surface to maintain the outward bias thereof in the second position.

8. The electrical connector of any one of the preceding claims, further characterized in that the outer housing is formed as a pair of opposing C-shaped members having their free ends interconnected.

9. The electrical connector of claim 4, further characterized in that the C-shaped members include the back-up shoulder and the resiliently expansive retention member such that when affixed to the inner housing the panel is captivated between the back-up shoulder and the retention member.

10. A connector for forming an interconnection through an opening in a wall comprising:

a first housing having a terminal receiving passageway therethrough;

a second housing mounted upon the first housing; and a retention mechanism for retaining the connector in the wall that includes a resiliently expansive retention member fixed to one of the housings that is spaced forwardly in the direction of insertion of the connector into the opening from a retention shoulder that extends outward from the connector beyond the opening to prevent over insertion, wherein said resiliently expansive retention member has a first position that fits through the opening and a second position, achievable in response to relative movement of the first and second housings, outward beyond the opening, in order to captivate the panel.

11. The connector of claim 10, wherein the resiliently expansive retention members are arms having a first end fixed to one of the housings and a locking head located opposite thereto that cooperates with a biasing tab to establish the second position.

12. The connector of claim 11, wherein the biasing tab includes a peak surface that supports the arm in the second position.

13. The connector of claim 11, wherein the biasing tab and locking head have complementary surfaces to retain the connector in the second position.

14. The connector of any one of claims 10–13, wherein the first and second housings are rotatable relative to one another to establish the first and second positions of the resiliently expansive member.

15. The electrical connector for mounting in an opening of a panel comprising a first connector housing having a plurality of terminal receiving passageways therethrough and having at least one biasing tab thereupon;

a second connector housing mountable upon the first connector and having a resiliently expansive member included therewith at a position from a back-up shoulder such that the panel may fit therebetween, the resiliently expansive member located to be biased outward beyond the opening in response to relative movement of the two housings that causes the biasing tab to cooperate with the resiliently expansive member.

* * * * *